US009445475B1

(12) United States Patent
Sutardja et al.

(10) Patent No.: US 9,445,475 B1
(45) Date of Patent: Sep. 13, 2016

(54) BUCK REGULATOR FOR LED LIGHTING COLOR MIXING AND/OR CURRENT COMPENSATION

(75) Inventors: Sehat Sutardja, Los Altos Hills, CA (US); Pantas Sutardja, Los Gatos, CA (US); Wanfeng Zhang, Palo Alto, CA (US)

(73) Assignee: Marvell International Ltd., Hamilton (BM)

( * ) Notice: Subject to any disclaimer, the term of this patent is extended or adjusted under 35 U.S.C. 154(b) by 859 days.

(21) Appl. No.: 13/551,118

(22) Filed: Jul. 17, 2012

Related U.S. Application Data

(60) Provisional application No. 61/514,361, filed on Aug. 2, 2011.

(51) Int. Cl.
*H05B 33/08* (2006.01)

(52) U.S. Cl.
CPC ..... *H05B 33/0857* (2013.01); *H05B 33/0824* (2013.01); *H05B 33/0827* (2013.01); *H05B 33/0845* (2013.01)

(58) Field of Classification Search
CPC ..... H05B 33/0815; H05B 33/0839; H05B 33/0857; H05B 33/0866; H05B 33/0848; H05B 33/083
USPC ..... 315/291, 294–295, 312, 314–315, 315/317–320
See application file for complete search history.

(56) References Cited

U.S. PATENT DOCUMENTS

2009/0195163 A1* 8/2009 Nguyen ..... H05B 33/0815 315/122
2010/0109570 A1* 5/2010 Weaver ..... 315/295

* cited by examiner

*Primary Examiner* — Jimmy Vu
*Assistant Examiner* — Henry Luong

(57) ABSTRACT

A light emitting diode (LED) lighting system includes a first string of first LEDs emitting light having a first color. A second string of second LEDs emits light having a second color and connected in series with the first string of first LEDs; A first switch and a second switch are connected in series. A regulator module is configured to modulate the first switch and the second switch to provide a desired current ratio. The desired current ratio corresponds to a ratio of a first current through the first string of first LEDs to a second current through the second string of second LEDs.

16 Claims, 4 Drawing Sheets

BUCK REGULATOR FOR LED LIGHTING COLOR MIXING AND/OR CURRENT COMPENSATION

CROSS-REFERENCE TO RELATED APPLICATIONS

This application claims the benefit of U.S. Provisional Application No. 61/514,361, filed on Aug. 2, 2011. The disclosure of the above application is incorporated herein by reference in its entirety.

FIELD

The present disclosure relates to buck regulators, and more particularly to buck regulators for lighting systems including light emitting diodes (LEDs).

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Light emitting diode (LED) lights include multiple diodes that are powered using direct current (DC) power. Typically, alternating current (AC) power is converted by a rectifier to DC power to generate a regulated current output at low voltage. For example, a control circuit for an LED lighting system may include an AC/DC converter stage that provides a DC source. Multiple DC regulators may communicate with the DC source to regulate current provided to respective LEDs in the LED lighting system.

SUMMARY

A light emitting diode (LED) lighting system includes a first string of first LEDs emitting light having a first color. A second string of second LEDs emits light having a second color and connected in series with the first string of first LEDs; A first switch and a second switch are connected in series. A regulator module is configured to modulate the first switch and the second switch to provide a desired current ratio. The desired current ratio corresponds to a ratio of a first current through the first string of first LEDs to a second current through the second string of second LEDs.

A method of operating a light emitting diode (LED) lighting system includes connecting first string of first LEDs emitting light having a first color in series with a second string of second LEDs emitting light having a second color, connecting a first switch in series with a second switch and modulating the first switch and the second switch to provide a desired current ratio. The desired current ratio corresponds to a ratio of a first current through the first string of first LEDs to a second current through the second string of second LEDs.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

Light emitting diode (LED) lighting systems (including, but not limited to, LED light bulbs and rope lights) may include two or more LEDs having different colors. For example, the LED lighting system may include one or more first LEDs having a first color, and one or more second LEDs having a second color. The LEDs may be separately controlled to independently control the respective colors. In other words, the respective LEDs of each of the colors may be separately controlled to achieve a desired mixing of the colors. For example, the LEDs having the first color may be controlled at a first brightness or intensity while the LEDs having the second color are controlled at a second brightness or intensity. The respective LEDs may be adjusted to achieve different color mixing characteristics.

An LED lighting system according to the principles of the present disclosure uses a single regulator (e.g., a buck regulator) to control LEDs having two different colors. For example, the regulator may control a first string of one or more LEDs having a first color that is connected in series with a second string of one or more LEDs having a second color. The regulator monitors and adjusts current provided to the first and second strings of LEDs to achieve a desired current ratio between the first and second strings of LEDs.

Figure 1:
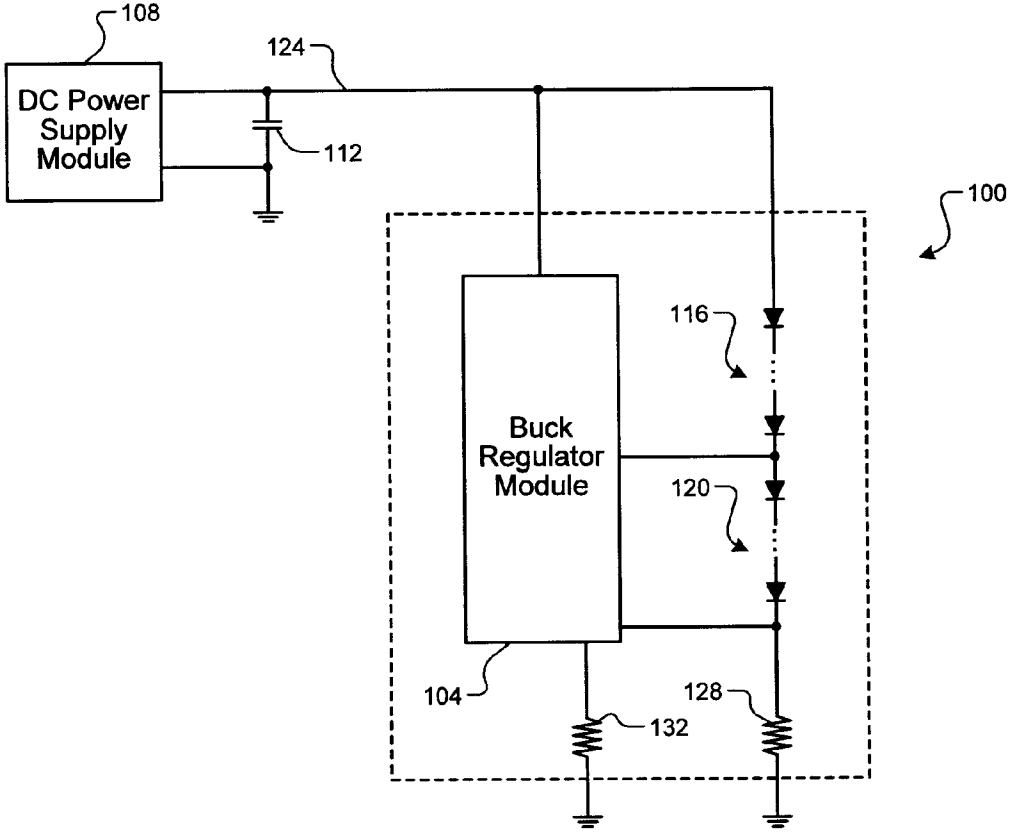
FIG. 1 illustrates a light emitting diode (LED) lighting system according to the principles of the present disclosure.

Referring now to FIG. 1, an LED lighting system 100 includes a buck regulator module 104. A DC power supply module 108 provides DC power (i.e., voltage and current) to the lighting system 100. For example, the DC power supply module 108 may communicate with an AC power supply (not shown) and convert the AC power to DC power. The DC power supply module 108 may include a constant power supply that supplies one or multiple DC voltage levels. A capacitor 112 provides buffering.

The buck regulator module 104 receives the DC power from the DC power supply module 108 and regulates power supplied to first LEDs 116 (e.g., a first string of LEDs) and second LEDs 120 (e.g., a second string of LEDs). The first LEDs 116 include one or more LEDs connected in series. Similarly, the second LEDs 120 include one or more second LEDs connected in series. Further, the first LEDs 116 and the second LEDs 120 are connected in series with one another (e.g., connected in series between an output 124 of the DC power supply module 108 and ground). For example only, the first LEDs 116 and the second LEDs 120 may be arranged in an LED bulb, rope light, and/or any other suitable LED device.

The first LEDs 116 and the second LEDs 120 may each correspond to the same color, or may each correspond to a different respective color. The buck regulator module 104 adjusts current provided to the first LEDs 116 and the second LEDs 120, respectively, to achieve desired color mixing characteristics (i.e., respective intensities or brightness of each color) of the LED lighting system 100. For example, the output 124 of the DC power supply module 108 may correspond to a total output current supplied to the LED lighting system 100. The buck regulator module 104 communicates with the output 124 (i.e., the total output current) and selectively adjusts respective currents through each of the first LEDs 116 and the second LEDs 120.

Figure 2:
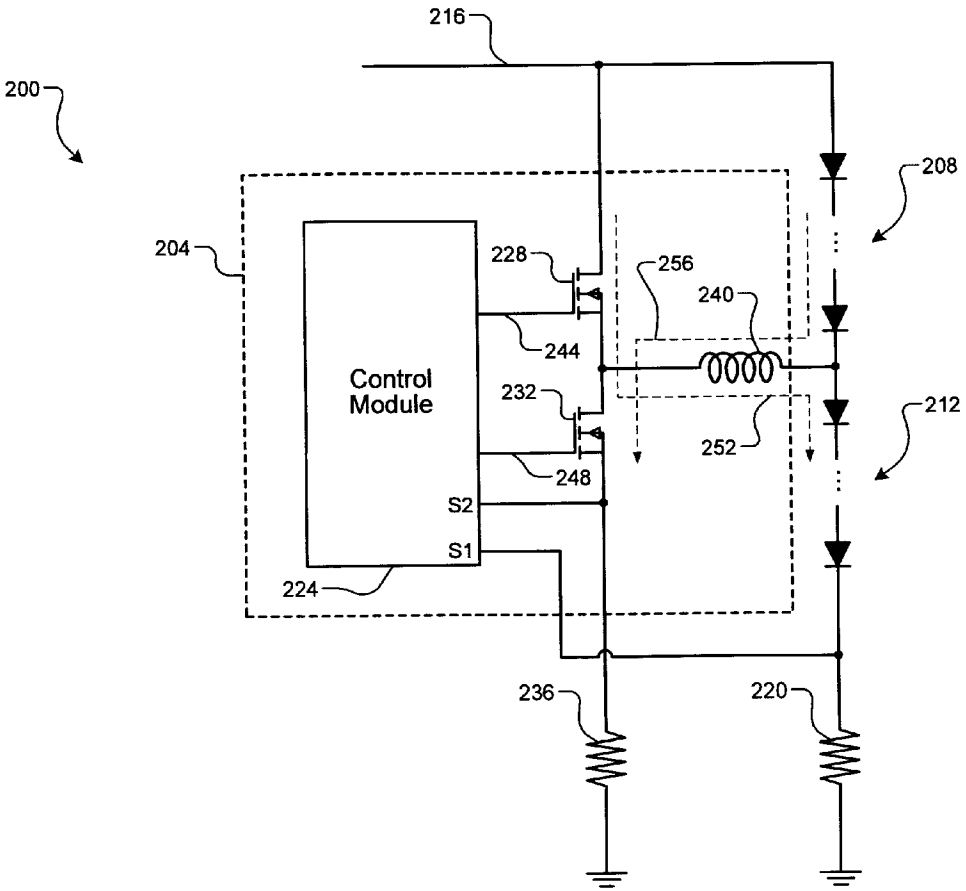
FIG. 2 illustrates a buck regulator module according to the principles of the present disclosure.

For example, the buck regulator module 104 may adjust a first current through the first LEDs 116 between zero and the total output current. Similarly, the buck regulator module 104 may adjust a current through the second LEDs 120 between zero and the total output current. Accordingly, the buck regulator module 104 adjusts a ratio (e.g., a current ratio of the total output current) of the first current through the first LEDs 116 to the second current through the second LEDs 120. For example only, the buck regulator module 104 may receive a current sensing inputs indicative of the current through the second LEDs 120 (via first current sense resistor 128) and a current through an inductor (as shown in FIG. 2) of the buck regulator module 104 (via second current sense resistor 132). The buck regulator module 104 adjusts the current ratio based in part on the current sensing input.

The current ratio corresponds to particular color mixing characteristics of the LED lighting system 100. As the current ratio is adjusted, the color mixing characteristics of the LED lighting system 100 are adjusted accordingly. For example, adjusting the current ratio to increase the first current through the first LEDs 116 and decrease the second current through the second LEDs 120 adjusts the color mixing characteristics to include more of a first color associated with the first LEDs 116 and less of a second color associated with the second LEDs 120. Conversely, adjusting the current ratio to decrease the first current through the first LEDs 116 and increase the second current through the second LEDs 120 adjusts the color mixing characteristics to include less of the first color and more of the second color.

In this manner, the buck regulator module 104 is configured to adjust the respective currents through both the first LEDs 116 and the second LEDs 120 and, accordingly, adjust the associated color mixing characteristics of both the first LEDs 116 and the second LEDs 120. In other words, only one buck regulator module 104 may be used to control the first LEDs 116 and the second LEDs 120 instead of using separate buck regulators to control the first LEDs 116 and the second LEDs 120. Accordingly, the LED lighting system 100 according to the principles of the present disclosure reduces a number of buck regulators used to control different strings of LEDs, reduces a die size of the buck regulator module 104, and reduces a cost of the LED lighting system 100.

Referring now to FIG. 2, an LED lighting system 200 includes a buck regulator module 204, first LEDs 208, and second LEDs 212. The first LEDs 208 and the second LEDs 212 receive a current from a DC output 216, and are connected to ground through a first current sense resistor 220. The buck regulator module 204 includes a control module 224, a first switch 228, and a second switch 232. The control module 224 communicates with control terminals of the switches 228 and 232. A first terminal of the switch 228 is connected to the DC output 216. A second terminal of the switch 228 is connected to a first terminal of the switch 232. A second terminal of the switch 232 is connected to ground through a second current sense resistor 236. A first end of an inductor 240 is connected between the second terminal of the switch 228 and the first terminal of the switch 232. A second end of the inductor 240 is connected between the first LEDs 208 and the second LEDs 212. The control module 224 outputs control signals 244 and 248 to operate the switches 228 and 232, respectively, to control an average current through each of the first LEDs 208 and the second LEDs 212. For example, the control module 224 may operate as a pulse width modulator control circuit.

More specifically, the control module 224 controls a current ratio (i.e., a ratio of the total output current of the DC output 216) between respective currents flowing through the first LEDs 208 and the second LEDs 212. For example, when the first switch 228 is closed (i.e., on) and the second switch 232 is open (i.e., off), the current will follow a first path 252 through the inductor 240 in a first direction, through the second LEDs 212, and through the first current sense resistor. Conversely, when the second switch 232 is closed and the first switch 228 is open, the current will follow a second path 256 through the first LEDs 208, through the inductor 240 in a second direction, and through the second current sense resistor 236. When both the first switch 228 and the second switch 232 are open, the total output current will flow through the first LEDs 208 and the second LEDs 212.

The control module 224 modulates (e.g., controls respective on and off times of) the switches 228 and 232 to control the respective average current through the first LEDs 208 and the second LEDs 212, and, accordingly, the ratio of the currents between the first LEDs 208 and the second LEDs 212 (i.e., the current ratio). For example only, the control module 224 communicates with the first current sense resistor 220 (e.g., via terminal S1) and the second current sense resistor 236 (e.g., via terminal S2) to monitor the respective currents (e.g., a current through the second LEDs 212 and a current through the inductor 240), and modulates the switches 228 and 232 based on the monitored currents and a desired current ratio. For example, the desired current ratio corresponds to desired color mixing characteristics of the LED lighting system 200.

In some examples, the control module 224 may be implemented as an integrated circuit. Or, the control module 224 and the switches 228 and 232, and/or other components of the LED lighting system 200, may be implemented as an integrated circuit. The switches 228 and 232 may include metal oxide semiconductor field effect transistors (MOSFETs) or other suitable transistors.

Figure 3:
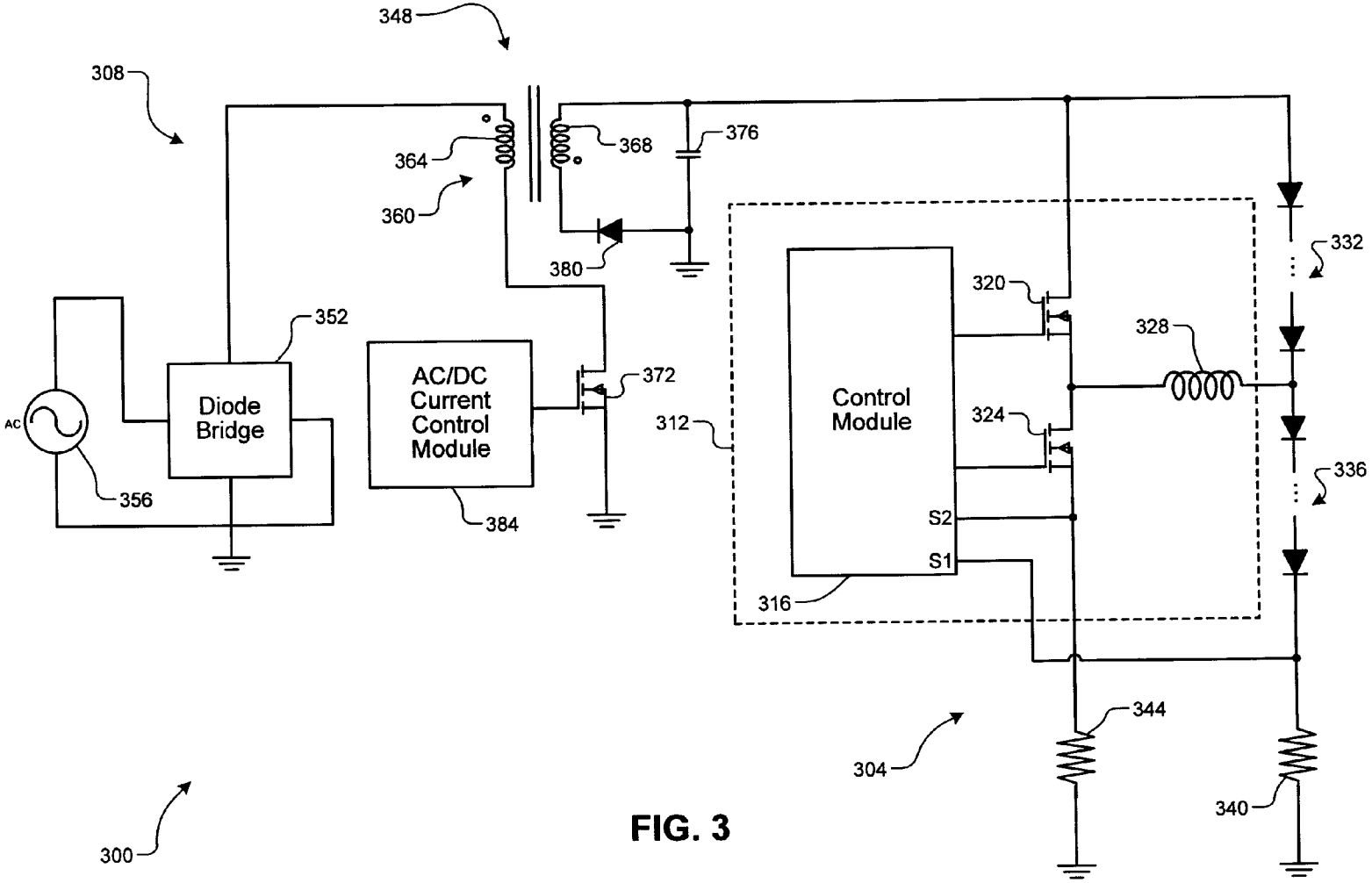
FIG. 3 illustrates an LED lighting circuit according to the principles of the present disclosure.

Referring now to FIG. 3, an example LED lighting circuit 300 includes an LED lighting system 304 and a DC power supply module 308. The LED lighting system 304 includes buck regulator module 312 (including, for example, a control module 316, a first switch 320 and a second switch 324, and an inductor 328), first LEDs 332 and second LEDs 336, a first current sense resistor 340, and a second current sense resistor 344.

The DC power supply module 308 includes, for example, a flyback converter 348 and a diode bridge 352. The diode bridge 352 is connected to an AC power source 356, and an output of the diode bridge 352 is connected to a transformer 360 having a primary side 364 and a secondary side 368. For example, the output of the diode bridge is connected to a first terminal of a primary side 364 of the transformer 360. A second terminal of the primary side 364 is connected to a reference terminal (e.g., ground) through a third switch 372. A first terminal of the secondary side 368 of the transformer 360 is connected to a capacitor 376. A second terminal of the secondary side 368 is connected to ground through a diode 380.

The flyback converter 348 converts an AC voltage (e.g., output from the AC power source 356) to a DC voltage, and provides a DC power source and an associated total output current. An AC/DC current control module 384 modulates the switch 372 to control an amount of the total output current. Accordingly, the AC/DC current control module 384 controls the total output current output by the DC power supply module 308, and the control module 316 controls the current ratio between the first LEDs 332 and the second LEDs 336.

Figure 4:
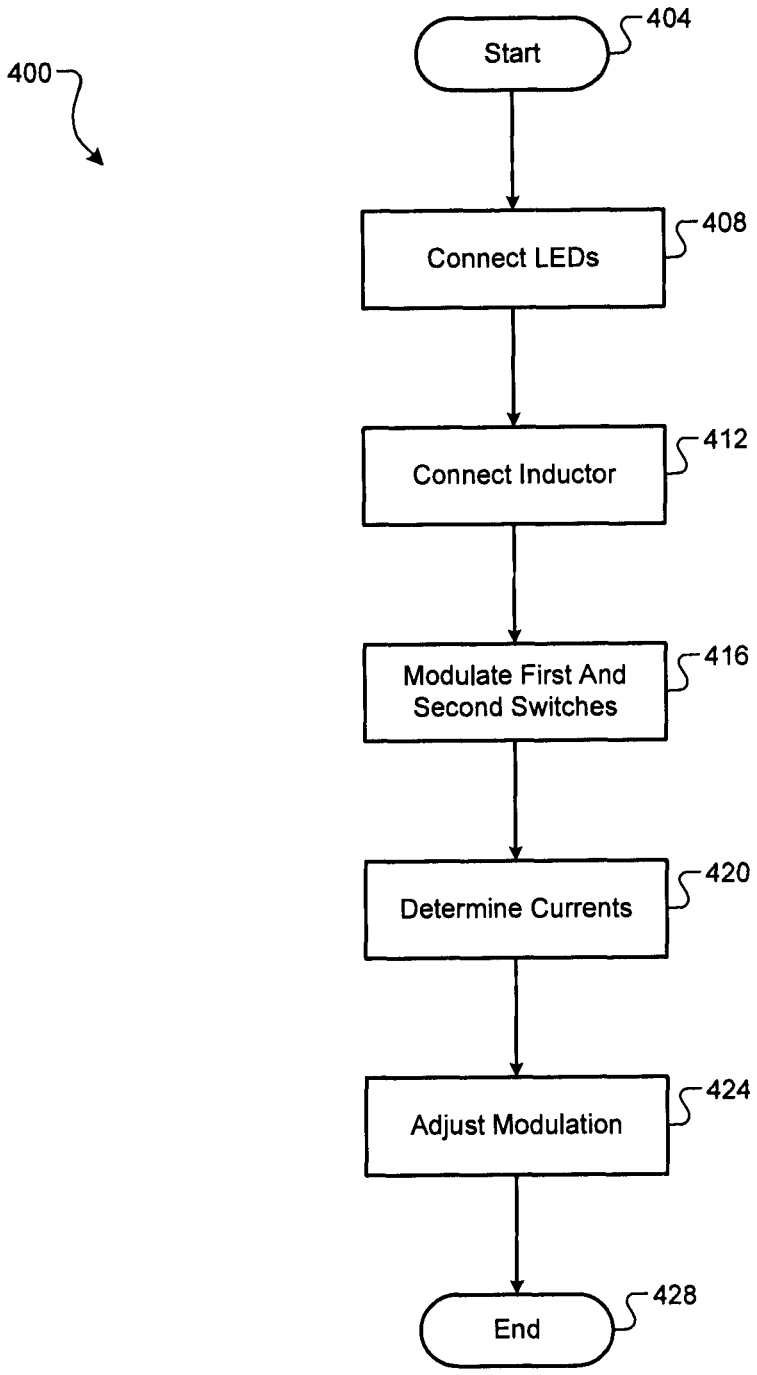
FIG. 4 illustrates a method of controlling an LED lighting system according to the principles of the present disclosure.

Referring now to FIG. 4, a method 400 of operating an LED lighting system begins at 404. At 408, first LEDs and second LEDs are connected in series between a DC power supply and a reference terminal (e.g., ground). For example, the first LEDs are associated with a first color and the second LEDs are associated with a second color. At 412, a first end of an inductor is connected between first and second switches and a second end of the inductor is connected between the first LEDs and the second LEDs. At 416, the method 400 modulates the first and second switches to control a current ratio between the first LEDs and the second LEDs. At 420, the method 400 determines respective currents through the second LEDs and the inductor. At 424, the method 400 adjusts modulation of the first and second switches based on the respective currents and a desired current ratio. The method 400 ends at 428.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A light emitting diode (LED) lighting system, comprising:

a first string of first LEDs emitting light having a first color;

a second string of second LEDs emitting light having a second color and connected in series with the first string of first LEDs;

a first switch;

a second switch connected in series with the first switch;

an inductor having (i) a first end connected between the first switch and the second switch, and (ii) a second end connected between the first string of first LEDs and the second string of second LEDs;

a first current sense resistor connected in series with the first string of first LEDs and the second string of second LEDs, wherein a first current flows through the second string of second LEDs and the first current sense resistor;

a second current sense resistor connected in series with the first switch and the second switch, wherein a second current flows through the first string of first LEDs and the second current sense resistor; and a regulator module configured to communicate with the first current sense resistor to receive a first current sensing input indicating the first current, communicate with the second current sense resistor to receive a second current sensing input indicating the second current, and modulate the first switch and the second switch, based on the received first current sensing input, the received second current sensing input, and a desired current ratio, to provide the desired current ratio, wherein the desired current ratio corresponds to a ratio of (i) the second current flowing through the first string of first LEDs and the second current sense resistor to (ii) the first current flowing through the second string of second LEDs and the first current sense resistor.

2. The LED lighting system of claim 1, wherein the desired current ratio defines a desired color mixing characteristic of the first string of first LEDs and the second string of second LEDs.

3. The LED lighting system of claim 1, wherein:

when the first switch is closed and the second switch is open, the first current flows in a first direction through the inductor and through the second string of second LEDs; and when the first switch is open and the second switch is closed, the second current flows through the first string of first LEDs and in a second direction through the inductor.

4. The LED lighting system of claim 1, wherein:

the first string of first LEDs and the second string of second LEDs are connected in series between a DC power source and ground.

5. The LED lighting system of claim 4, further comprising a power supply module configured to convert an AC power source to the DC power source.

6. The LED lighting system of claim 4, wherein the DC power source includes a flyback converter.

7. The LED lighting system of claim 1, wherein the regulator module is configured to communicate with the first current sense resistor to determine the first current, and communicate with the second current sense resistor to determine the second current.

8. The LED lighting system of claim 7, wherein the regulator module is configured to modulate the first switch and the second switch based on the first current, the second current, and the desired current ratio.

9. A method of operating a light emitting diode (LED) lighting system, the method comprising:

connecting first string of first LEDs emitting light having a first color in series with a second string of second LEDs emitting light having a second color;

connecting a first switch in series with a second switch;

connecting a first end of an inductor between the first switch and the second switch;

connecting a second end of the inductor between the first string of first LEDs and the second string of second LEDs;

connecting a first current sense resistor in series with the first string of first LEDs and the second string of second LEDs, wherein a first current flows through the second string of second LEDs and the first current sense resistor;

connecting a second current sense resistor in series with the first switch and the second switch, wherein a second current flows through the first string of first LEDs and the second current sense resistor;

communicating with the first current sense resistor to receive a first current sensing input indicating the first current;

communicating with the second current sense resistor to receive a second current sensing input indicating the second current;

modulating the first switch and the second switch, based on the received first current sensing input, the received second current sensing input, and a desired current ratio, to provide the desired current ratio, wherein the desired current ratio corresponds to a ratio of (i) the second current flowing through the first string of first LEDs and the second current sense resistor to (ii) the first current flowing through the second string of second LEDs and the first current sense resistor.

10. The method of claim 9, wherein the desired current ratio defines a desired color mixing characteristic of the first string of first LEDs and the second string of second LEDs.

11. The method of claim 9, wherein:

when the first switch is closed and the second switch is open, the first current flows in a first direction through the inductor and through the second string of second LEDs; and when the first switch is open and the second switch is closed, the second current flows through the first string of first LEDs and in a second direction through the inductor.

12. The method of claim 9, wherein:

the first string of first LEDs and the second string of second LEDs are connected in series between a DC power source and ground.

13. The method of claim 12, further comprising converting an AC power source to the DC power source.

14. The method of claim 13, further comprising converting the AC power source to the DC power source using a flyback converter.

15. The method of claim 9, further comprising:

communicating with the first current sense resistor to determine the first current;

communicating with the second current sense resistor to determine the second current.

16. The method of claim 15, further comprising modulating the first switch and the second switch based on the first current, the second current, and the desired current ratio.

* * * * *